United States Patent [19]

Allen

[11] Patent Number: 4,782,952

[45] Date of Patent: Nov. 8, 1988

[54] MEDICATION SUPPLY HOLDER/ORGANIZER

[76] Inventor: Judy P. Allen, 1912 Warfield Ave., Redondo Beach, Calif. 90278

[21] Appl. No.: 135,393

[22] Filed: Dec. 21, 1987

[51] Int. Cl.[4] ..... B65D 83/04; B65D 85/42

[52] U.S. Cl. ..... 206/534; 206/459

[58] Field of Search ..... 206/534, 459

[56] References Cited

U.S. PATENT DOCUMENTS

| | | | |
|---|---|---|---|
| 4,473,156 | 9/1984 | Martin | 206/534 |
| 4,526,474 | 7/1985 | Simon | 206/534 |
| 4,666,991 | 4/1987 | Simon | 206/534 |
| 4,693,371 | 9/1987 | Malpass | 206/534 |
| 4,706,815 | 11/1987 | Curtis et al. | 206/534 |
| 4,731,765 | 3/1988 | Cole et al. | 206/534 |

*Primary Examiner*—Joseph Man-Fu Moy

*Attorney, Agent, or Firm*—William H. Drummond

[57] ABSTRACT

A medication supply holder and dose organizer for assisting a patient in taking timed dosages of multiple medications. This device includes a base member of temporarily storing bulk quantities of separate medications and a plurality of timed-dose medication holders which also include an erasable marking surface for displaying prescription information. Means are provided for carrying a plurality of these timed-dose holders in at least two operative positions, the first of which indicates the next dose to be taken and the second of which is a position to which the holder last used is moved to expose the next holder in sequence.

1 Claim, 1 Drawing Sheet

MEDICATION SUPPLY HOLDER/ORGANIZER

This invention pertains to a device for temporarily holding bulk supplies of various medications and organizing timed dosages of such medications to assist a patient in remembering which and when to take a dose of each such medication.

More particularly, the invention concerns such a device which enables a patient to systematically premeasure and segregate bulk medications into timed dosages and to remind the patient when each such timed dose is to be taken.

Patients who have a single medical condition which requires treatment by taking timed dosages of various medications frequently have difficulty remembering when to take each separate 4 medication. This problem is considerably more serious when the patient suffers from more than one medical condition which requires taking different medications for each condition at timed intervals Moreover, this entire problem is compounded by the fact that such patients may frequently have impairments of sight is or memory which make such normally simple tasks even more difficult.

Even where such patients have the assistance of family members or medical personnel in organizing dosages of different medicines to be taken during the day, a simple method of physical ly segregating the timed dosages and reminding the patient which groups of medicines are to be taken next and at what time becomes a complicated and sometimes almost impossible task for the individual patient.

There is a significant need for some means for assisting a patient or his attendants in organizing such timed dosages of multiple medications and for reminding the patient or his attendant of the need to take the next dose according to prescription.

Accordingly, the principal object of the present invention is to provide an improved device for temporarily holding bulk supplies of various medicines and for organizing such medicines to assist the patient in determining or remembering when to take the next timed dose.

A further object of the invention is to provide such a device which is simple and economical to manufacture, rugged construction and simple operation.

These, other and further objects and advantages of the invention will be apparent from the following detailed description thereof, taken in conjunction with the drawings in FIG. 1 is a perspective view of a medication supply holder and organizer constructed in accordance with the principles of the invention;

Figure 1:
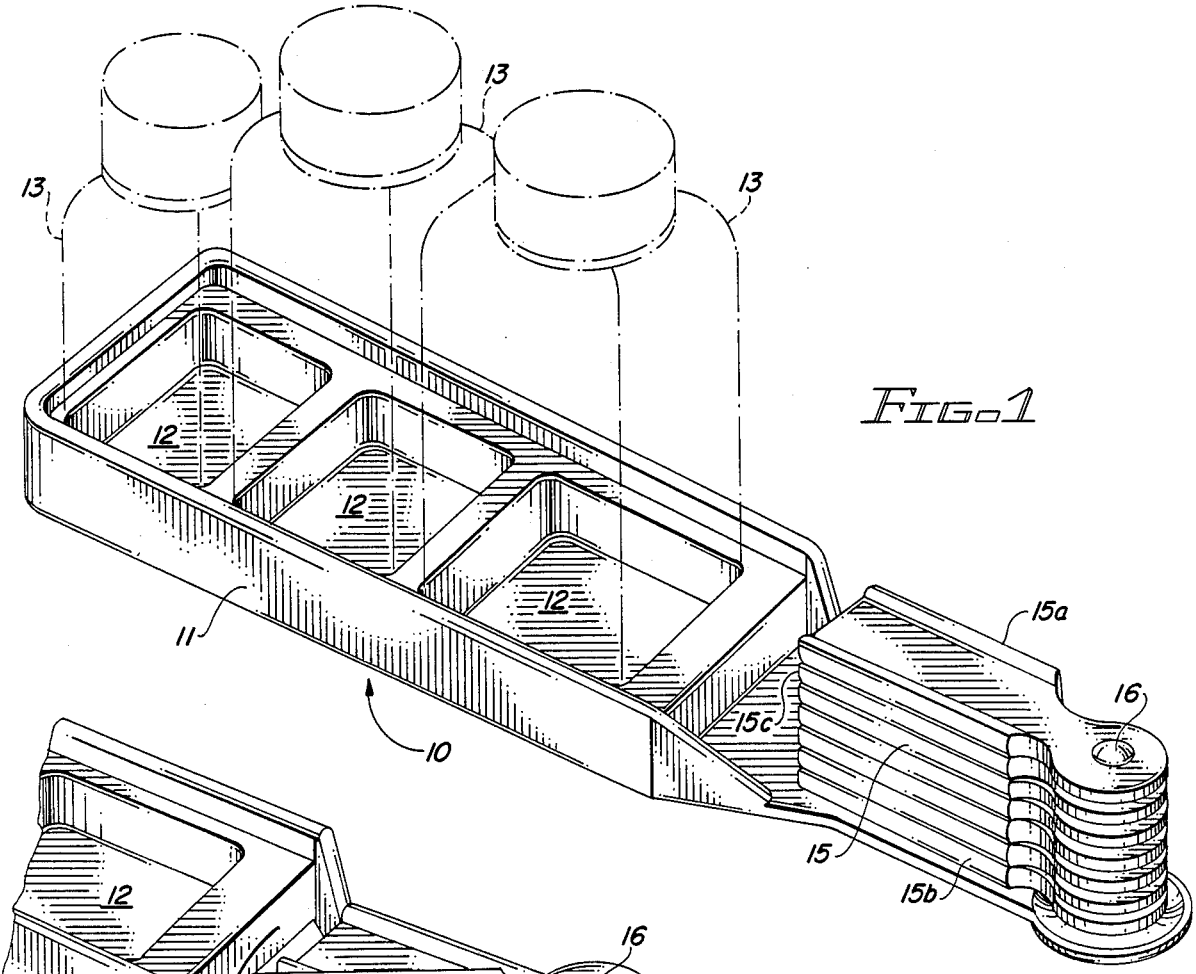

Briefly, in accordance with the invention, I provide a medication supply holder and dose-organizer for assisting a patient in taking timed dosages of multiple medications.

The device of the invention comprises a base member, a plurality of timed-dose medication holders and means for carrying the plurality of holders on the base.

The base member includes a storage portion for temporarily locating a plurality of containers for separately storing bulk quantities of different medications. A plurality of timed-dose medication holders are provided, each of which includes a tray for temporarily storing a plurality of different medication doses and an erasable marking surface for displaying the time at which the medication dosages of each such tray are to be taken by the patient and other information such as the names of each medication on the tray and the quantities of each.

Finally, means are provided for carrying the plurality of medication holders on the base in at least two operative positions. In the first position, each such holder is temporarily maintained until the medication doses carried thereby are taken by the patient. After the medication doses on each tray is taken by the patient, that holder is moved to the second operative position.

Movement of each holder from the first position to the second position automatically exposes the holder carrying the medication doses to be taken next in sequence by the patient.

Turning now to the drawings, in which like reference characters identify the same elements in the several views, FIG. depicts the presently preferred embodiment of the invention. The base member, generally indicated by reference numeral 10, includes a portion 11 with integrally-formed recesses 12 for temporarily holding bottles 13 for storing bulk quantities of several different medications. These bottles 13 are advantageously carried in the recesses 12 as a means for keeping track of the various kinds of medications which must be taken by the patient during a time period, e.g., one day, one week, etc.

Figure 2:
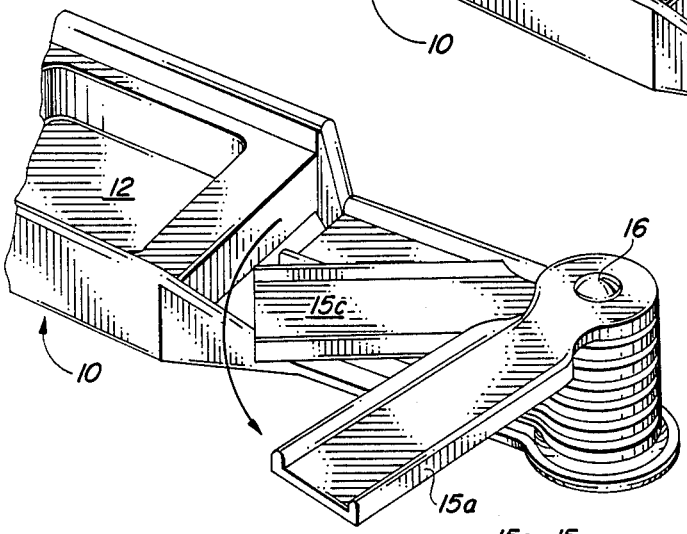
FIG. 2 is a perspective view of the device of FIG. 1 illustrating movement of the dose organizing holders.
Figure 3:
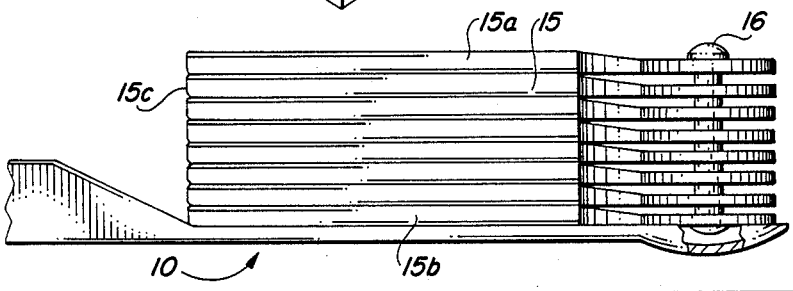
FIG. 3 is a partially cut-away side view of the device of FIG. 1.
Figure 4:
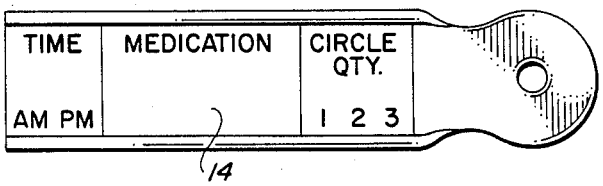
FIG. 4 is a plan view of one of the dose organizing holders of the device of FIGS. 1–3.

The dosage information normally found on prescription labels (not shown) affixed to the bottles 13 is transferred by marking on erasable surfaces 14 carried on individual medication holders 15 carried in vertically-stacked relation for pivotal movement (see FIG. 2) on a pin 16.

After prescription information is written on the erasable surfaces 14 of the trays 15, individual doses of each of the medicines in the bottles 13, as called for by prescriptions, are organized on each of the trays 15 in chronological sequence from the top tray **15*a* downwardly to the bottom tray 15*b***.

With the series of timed doses for the given period (day, week, etc.) so-organized on the trays 15, the entire device is simply placed at a convenient location within proximity to the patient. The device then presents the first medication dosage on the top tray **15*a* along with the time (marked on the erasable surface 14) at which the medicines on the tray 15*a* are to be taken. After these dosages are taken, the tray 15*a* is swung away from the stacked relation of FIG. 1 to expose the tray 15*c* carrying the next of the timed medication dosages. This procedure is repeated until the last timed dose on the tray 15*b* is taken by the patient, after which the trays 15 are reloaded with medication from the bottles 13** according to the prescription information thereon.

Having described my invention in such terms as to enable those skilled in the art to which it pertains to understand and practice it, and having described the presently preferred embodiments thereof, I claim:

1. A medication supply holder and dose-organizer for assisting a patient taking timed dosages of multiple medications, said device comprising:

(a) a base member, including a storage portion for temporarily locating a plurality of containers for separately storing bulk quantities of each said medication;

(b) a plurality of timed-dose medication holders, each said holder including (i) a tray for temporarily storing a plurality of different medication doses, (ii) means forming an erasable marking surface for displaying prescription information of each;

(c) means for carrying said plurality of holders on said base in at least two operative positions, (i) a first position in which each said holder is temporarily maintained until the medication doses carried thereby are taken by the patient, and (ii) a second position in which each said holder is maintained after the medication dosages carried thereby are taken by the patient, movement of each said holder from said first position to said second position automatically exposing the holder carrying the medication doses to be taken next in sequence by the patient.

* * * * *